US005335911A

United States Patent [19]

Brown

[11] Patent Number: 5,335,911

[45] Date of Patent: Aug. 9, 1994

[54] TOY FISHING APPARATUS

[76] Inventor: Lawrence W. Brown, 568 NW. Wide Ave., Roseburg, Oreg. 97470

[21] Appl. No.: 139,768

[22] Filed: Oct. 22, 1993

[51] Int. Cl.[5] ..... A63F 9/00

[52] U.S. Cl. ..... 273/140; 273/456; 446/139

[58] Field of Search ..... 446/137, 139, 138, 129, 446/131-134; 273/456, 140

[56] References Cited

U.S. PATENT DOCUMENTS 484,950 10/1892 Dungey ..... 446/139
2,557,789 6/1951 Lamka ..... 446/139

FOREIGN PATENT DOCUMENTS 894516 10/1953 Fed. Rep. of Germany ..... 446/139

*Primary Examiner*—Mickey Yu
*Attorney, Agent, or Firm*—E. Michael Combs

[57] ABSTRACT

A toy fishing apparatus includes a fishing rod and reel cooperative with a bait fish that is formed with a magnetic core, such that the bait fish is arranged to selectively magnetically adhere one of a plurality of "target fish". Each of the target fish is arranged for magnetic attraction to the bait fish, wherein selective ones of the target fish are filled within a hollow cavity of the target fish of various prizes such as jewelry, money, and the like. Individuals attempt to buy chance and magnetically adhere a target fish with the greatest number of prize components stored therewithin.

4 Claims, 4 Drawing Sheets

TOY FISHING APPARATUS

BACKGROUND OF THE INVENTION

1. Field of the Invention

The field of invention relates to toy fishing apparatus, and more particularly pertains to a new and improved toy fishing apparatus wherein the same is arranged for the chance attraction of prize components within fish secured by a fishing pole and bait fish construction.

2. Description of the Prior Art

Fishing toy structure of various types are indicated in the prior art and exemplified by the U.S. Pat. Nos. 4,838,553; 4,432,544; 4,224,761; 4,936,574; and 5,050,876, wherein a magnetic fishing toy is provided providing for rotating magnetic counterparts within housing recesses of a support container.

The instant invention attempts to overcome deficiencies of the prior art by providing for a new and improved toy fishing apparatus wherein the same is arranged for the ease of simulating a fishing experience and obtaining a trophy type target fish and in this respect, the present invention substantially fulfills this need.

SUMMARY OF THE INVENTION

In view of the foregoing disadvantages inherent in the known types of toy fishing apparatus now present in the prior art, the present invention provides a toy fishing apparatus wherein the same is directed to the magnetic adherence of trophy fish by a bait fish. As such, the general purpose of the present invention, which will be described subsequently in greater detail, is to provide a new and improved toy fishing apparatus which has all the advantages of the prior art toy fishing apparatus and none of the disadvantages.

To attain this, the present invention provides a toy fishing apparatus including a fishing rod and reel cooperative with a bait fish that is formed with a magnetic core, such that the bait fish is arranged to selectively magnetically adhere one of a plurality of "target fish". Each of the target fish is arranged for magnetic attraction to the bait fish, wherein selective ones of the target fish are filled within a hollow cavity of the target fish of various prizes such as jewelry, money, and the like. Individuals attempt to buy chance and magnetically adhere a target fish with the greatest number of prize components stored therewithin.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy fishing apparatus which has all the advantages of the prior art toy fishing apparatus and none of the disadvantages.

It is another object of the present invention to provide a new and improved toy fishing apparatus which may be easily and efficiently manufactured and marketed.

It is a further object of the present invention to provide a new and improved toy fishing apparatus which is of a durable and reliable construction.

An even further object of the present invention is to provide a new and improved toy fishing apparatus which is susceptible of a low cost of manufacture with regard to both materials and labor, and which accordingly is then susceptible of low prices of sale to the consuming public, thereby making such toy fishing apparatus economically available to the buying public.

Still yet another object of the present invention is to provide a new and improved toy fishing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
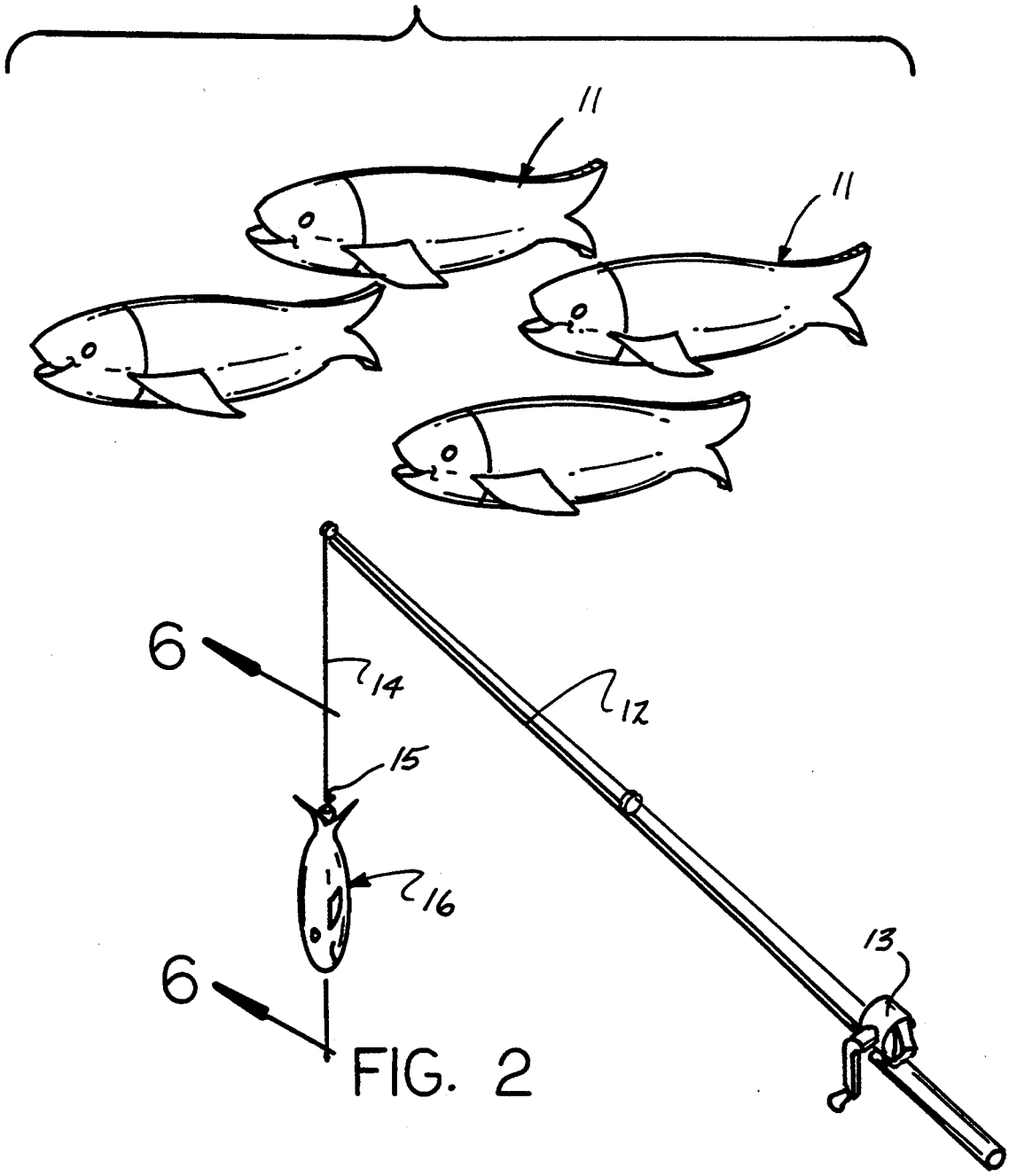
FIG. 1 is an isometric illustration of examples of target fish members employed by the invention.
FIG. 2 is an isometric illustration of the fishing rod and bait fish construction.

With reference now to the drawings, and in particular to FIGS. 1 to 8 thereof, a new and improved toy fishing apparatus embodying the principles and concepts of the present invention and generally designated by the reference numerals 11–37 will be described.

More specifically, the toy fishing apparatus of the invention essentially comprises a plurality of target fish members 11. The target fish members may vary in total number from two to twenty, but typically such fish may be utilized, wherein each of the target fish are mirror replications of each other and for purposes of discussion and illustration, only one of such target fish members will be described relative to the FIGS. 1, 3–5, and FIGS. 7 and 8.

Figure 6:
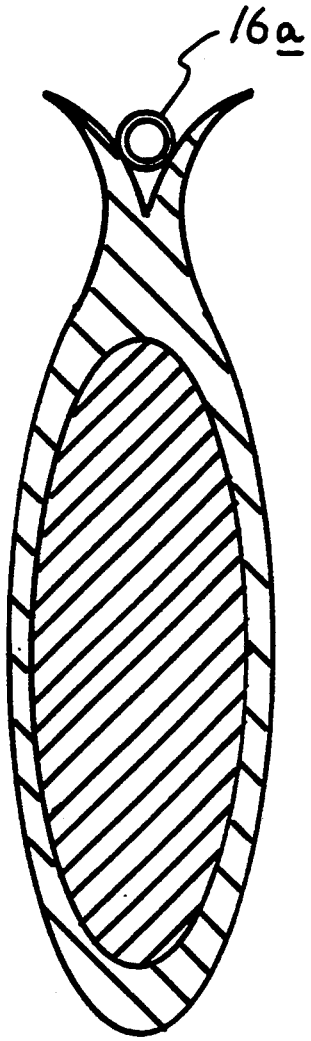
FIG. 6 is an orthographic cross-sectional illustration of the bait fish member.
Figure 7:
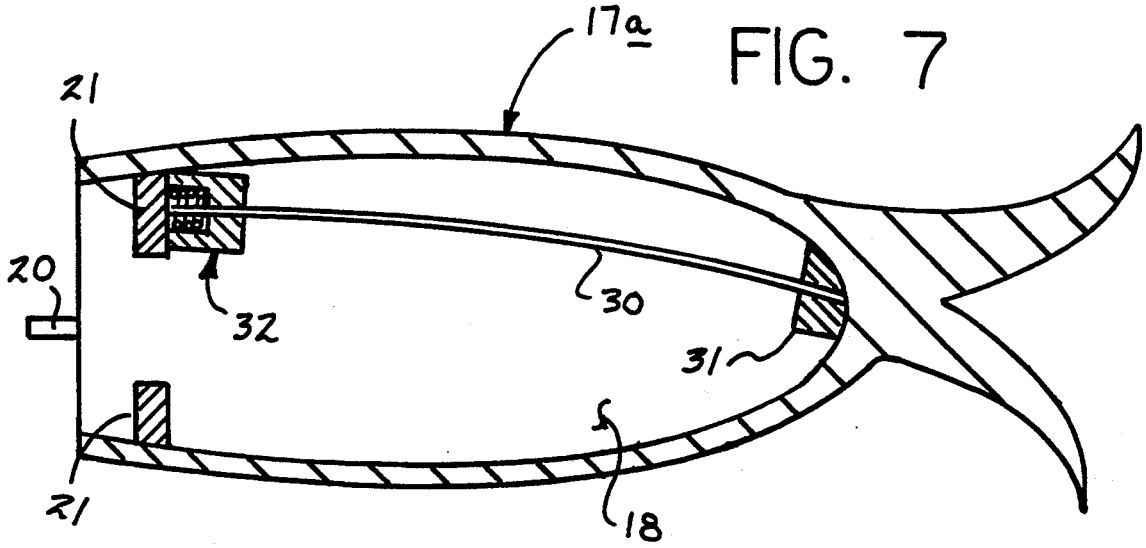
FIG. 7 is an orthographic cross-sectional illustration of a modified target fish body.
Figure 8:
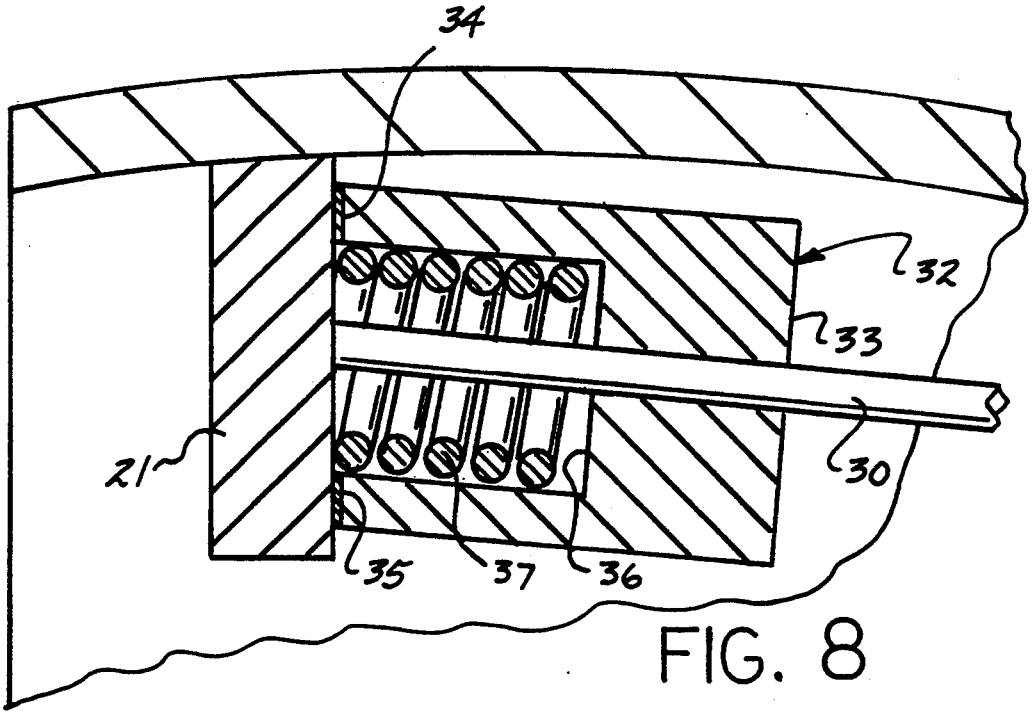
FIG. 8 is an enlarged orthographic view of the slide weight construction, as indicated in FIG. 7.

A fishing pole 12, along with a fishing reel 13, is provided, wherein fishing line 14 directed from the reel 13 along the fishing pole 12 terminates in a hook 15 for support of a bait fish member 16. The bait fish member 16 (see FIG. 6) is formed with a ring 16*a* to receive the hook therethrough for suspension from the fishing line 14, as illustrated in FIG. 2. The bait fish is formed with a shell 28, having a magnetic core 23 directed coextensively throughout the bait fish, as indicated in FIG. 6.

Each of the target fish members 11 are formed with a body 17 having a cavity 18 directed along the body, having an entrance end 19 in communication with the cavity 18. Spaced fin flanges 20 are mounted to the body projecting exteriorly thereof and fixedly secured to the body 17 projecting beyond the entrance end 19, such that a head portion 22 formed of a ferrous metallic material arranged for magnetic adherence and attraction to the magnetic core 29 of the bait fish member 16 is such that the head portion 22 includes a magnetic plate 23 (see FIG. 5) for magnetic adherence to spaced ferrous metallic abutment flanges 21 that are arranged in a coplanar arrangement relative to one another and positioned Within the cavity 18 in adjacency to the entrance end 19, such that the magnetic plate 23 is adhered to the abutment flanges 2l when the head portion 22 is directed into the cavity 18. Further, the head portion 22 includes spaced head slots 24 to receive the fin flanges 20 projecting beyond the elongate body 17 to prevent rotation of the head portion relative to the body 17. Within the cavity 18 and positioned therewithin, various prize components 26 (see FIG. 4) such as jewelry, money, and the like is positioned within the cavity 18 directed thereto through the spacing 27 between the abutment flanges 21. In this manner, when the bait fish is directed along one of the target fish 11, the head 22 is adhered to the bait fish by the magnetic attraction of the magnetic core 29 to the head portion 22. By chance, a winner will be declared by that individual having obtained the greatest value of prize components 26. The manner of taking turns of various players may be subject to individual and arbitrary decision among players, wherein typically sequential play is indicated and as each player sequentially attracts a target fish member 11, that respective individual player will total values that may be arbitrarily assigned to the prize components 26 to declare a winner having attained the greatest number of such components in value.

Figure 3:
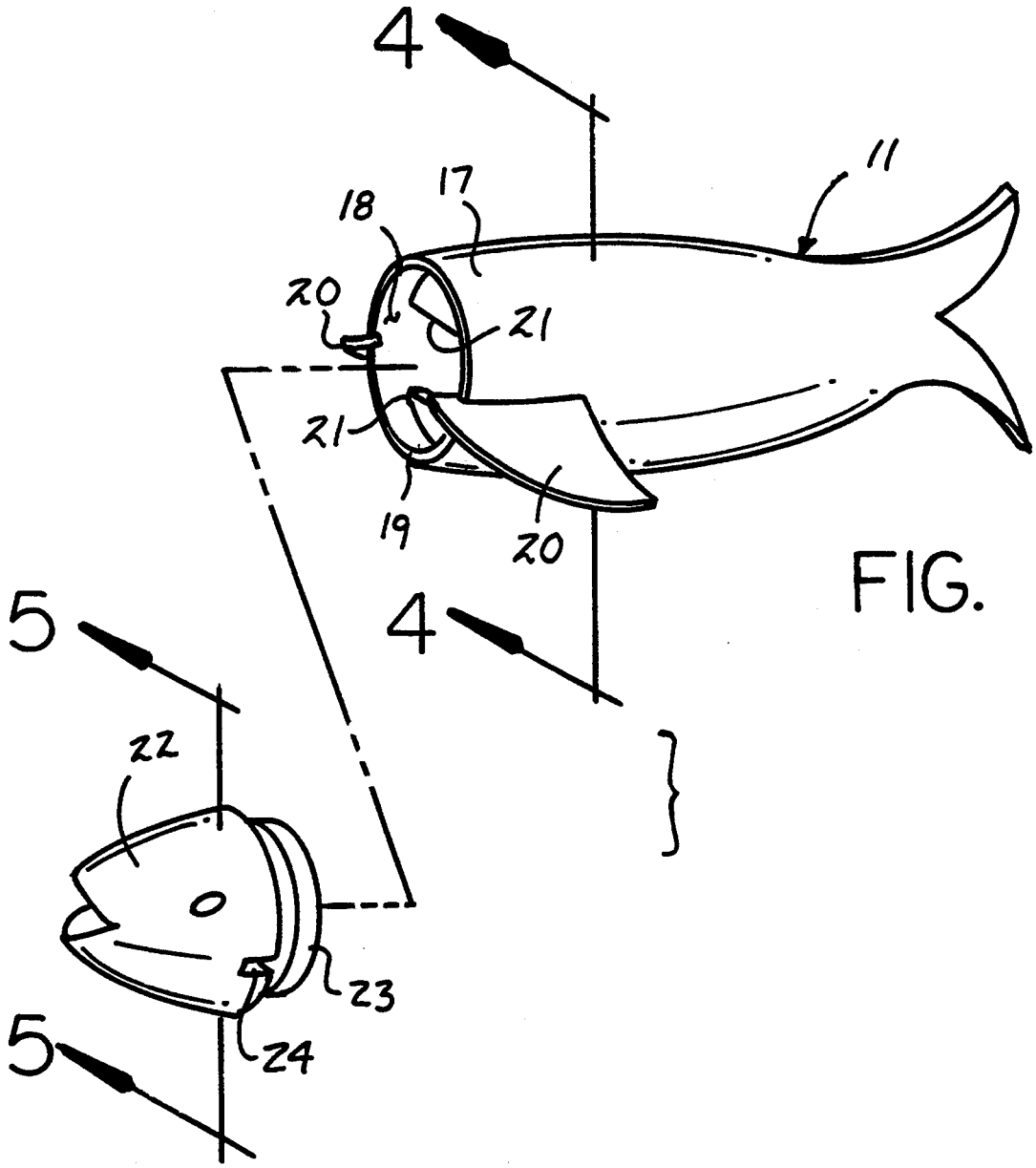
FIG. 3 is an enlarged isometric illustration in a disassembled configuration of a target fish.
Figure 4:
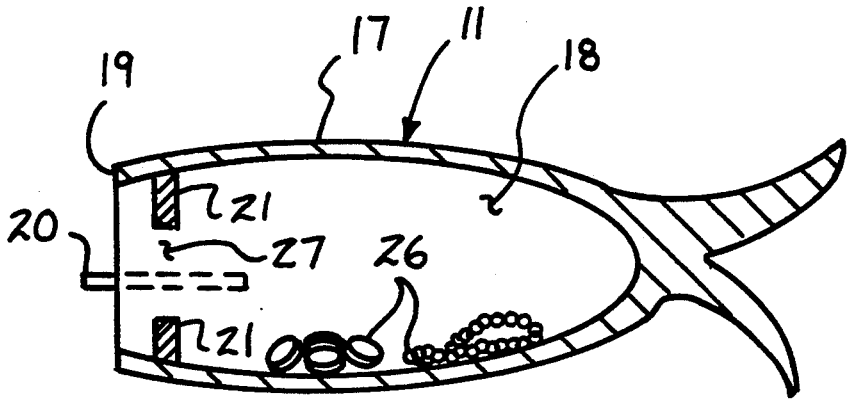
FIG. 4 is an orthographic view, taken along the lines 4—4 of FIG. 3 in the direction indicated by the arrows.
Figure 5:
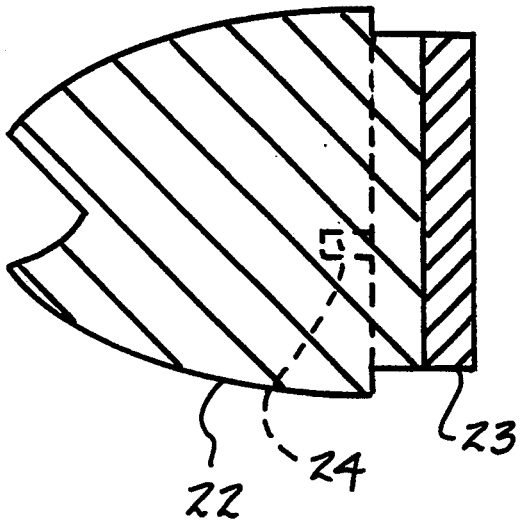
FIG. 5 is an orthographic view, taken along the lines 5—5 of FIG. 3 in the direction indicated by the arrows.

The FIG. 17*a* indicates a modified body 17*a*, wherein and in addition to the structure as indicated in the FIGS. 3 and 4, a guide rod 30 is positioned therewithin, having a guide rod abutment 31 mounted to the guide rod fixedly thereto at a rearwardmost end of the cavity 18, with the guide rod having a slide weight 32 slidably directed therealong. The slide weight includes a rear end wall 33 arranged to impact in a facing relationship relative to the abutment 31 , with a slide weight front wall 34 including a magnetic ring 35 mounted to the slide weight front wall 34 for magnetic adherence to the one abutment flange 21 . A slide weight socket cavity 36 directed into the slide weight through the slide weight front wall 34 has a spring 37 captured between the second cavity floor 36*a* and the abutment 21, such that upon undue vibration directed to the target fish during a fish catching procedure, the pressure of the spring 37 directed to the abutment 21 in addition to the vibration will effect deflection and displacement of the slide weight that will then slide along the guide rod 30 to impact the abutment 31 and thereby dislodge the target fish from the bait fish during a fishing procedure to add an additional degree of difficulty to the fishing procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy fishing apparatus, comprising, a plurality of target fish members, a fishing pole having a fishing line extending from the fishing pole, with the fishing line including fishing line free distal end, and a hook mounted to the fishing line free distal end, and a bait fish member, the bait fish member including a body member having a body rearwardmost end, with fastening means mounted to the rearwardmost end for securement to the hook, and the bait fish member including a continuous outer shell, and a magnetic core positioned coextensively and complementarily within the outer shell, and each of the target fish members having an elongate body including a head portion formed of a ferrous metallic material arranged for magnetic adherence to the bait fish member, and securement means for securing the head portion to the elongate body, and the securement means includes the head portion having a shank, the shank having a magnetic plate mounted to the shank, and the elongate body having a body cavity, with the elongate body having an entrance end in communication to the body cavity, and spaced coplanar abutment flanges mounted within the cavity in adjacency to the entrance end, with the magnetic plate arranged for magnetic adherence to the abutment flanges.

2. An apparatus as set forth in claim 1 wherein the abutment flanges are arranged in a spaced relationship relative to one another, with a prize component positioned within the cavity.

3. An apparatus as set forth in claim 2 wherein the head portion includes head slots, and the elongate body includes spaced fin flanges extending laterally of the elongate body and projecting beyond the entrance end, with the slots arranged to receive the spaced fin flanges to prevent rotation of the head portion relative to the elongate body.

4. An apparatus as set forth in claim 3 wherein the cavity includes a cavity rearwardmost end spaced from the abutment flanges, and the cavity rearwardmost end includes an abutment block, and a guide rod fixedly mounted to the abutment block extending from the abutment block to one of said abutment flanges, and a slide weight slidably directed along the guide rod, the slide weight having a rear end wall arranged in facing relationship relative to the abutment block, and a slide weight front wall arranged in a facing relationship to said one of said abutment flanges, wherein a slide weight socket cavity is directed into the slide weight through the front wall, wherein the slide socket cavity includes a cavity floor and a spring interposed between the cavity floor and the at least one of said abutment flanges, with the slide weight front wall further including a magnetic ring in surrounding relationship relative to the spring, whereupon undue vibration imparted to the slide weight when the magnetic ring is adhered to said one of said abutment flanges effects displacement of the slide weight relative to the said at least one of said abutment flanges directing the slide weight along the guide rod to impact the abutment block.

* * * * *